US005611424A

United States Patent [19]

Sniezek et al.

[11] Patent Number: 5,611,424

[45] Date of Patent: Mar. 18, 1997

[54] CONTAINER FUSE FOR ENHANCED SURVIVABILITY

[75] Inventors: Frank Sniezek, Westfield; Eugene M. Ivankoe, Chatham; Steve Ruffini, Budd Lake, all of N.J.

[73] Assignee: The United States of America as represented by the Secretary of the Army, Washington, D.C.

[21] Appl. No.: 687,101

[22] Filed: Jul. 11, 1996

[51] Int. Cl.[6] ..... B65D 45/00

[52] U.S. Cl. ..... 206/3; 220/202

[58] Field of Search ..... 220/201, 202, 220/203.01; 206/3

[56] References Cited

U.S. PATENT DOCUMENTS 4,979,632 12/1990 Lee ..... 206/3

5,248,055 9/1993 Sanai et al. ..... 206/3 X

*Primary Examiner*—Jacob K. Ackun

*Attorney, Agent, or Firm*—Saul Elbaum; Edward Goldberg; Michael Sachs

[57] ABSTRACT

A sealed metal ammunition container for holding at least one round of ammunition. The container body is sized to hold the ammunition and has an opening at one end thereof. A metal bottom flange is fixedly attached to file container body at the one end and includes an opening therein sufficiently large to vent pressure from ignited energetic contained therein. A metal top flange is provided for attachment to the bottom flange, the top flange also having a similar opening therein. A fuse formed from a material having a melting point below the ignition temperature of the ammunition is positioned between the top flange and the bottom flange to form a meltable closure at the open end of the body. A rubber flange gasket is positioned between the bottom flange and the fuse to form a hermetic seal when compressed upon closure thereof. Equally spaced screws mount the top flange, fuse, and flange gasket to the bottom flange to form a hermetic seal. The fuse is preferably formed from a synthetic material having a melting point between 190° F. and 270° F. Most preferred is an ionomer plastic material reinforced with glass fibers and has a melting point of about 250° F. to about 270° F.

9 Claims, 1 Drawing Sheet

CONTAINER FUSE FOR ENHANCED SURVIVABILITY

The invention described herein may be made, used, or licensed by or for the Government for Governmental purposes.

FIELD OF THE INVENTION

The present invention relates to a safety device for use with ammunition. More particularly the present invention relates to a container fuse that reduces the severity of a reaction caused by ammunition that has been exposed to a storage fire by providing pressure venting. The pressure venting reduces the reaction from a severe deflagration reaction to a burning that may be controlled or, at least, substantially reduces the hazard to surrounding facilities.

BACKGROUND OF THE INVENTION

In the past, namely at least twenty years ago and back in time, ammunition was packaged in wooden containers. The hazards associated with storage fires of ammunition packaged in wooden containers are considerably less severe than for the same ammunition packaged in metal containers. Wood, however, is no longer an acceptable material for use in ammunition packaging since it will not satisfy all present ammunition packaging requirements. Containers made of metal are nuclear, biological and chemical decontaminable, hold a pressure seal for long term storage, are resealable and are reusable. Wood satisfies none of these requirements sufficiently well.

Ammunition has been stored in metal containers now, for about the last twenty years, satisfying some of the above noted deficiencies of wood but creating other problems. Ammunition that is confined in a sealed metal container when exposed to a storage fire without any way of pressure venting, result in a rapid buildup of pressure inside the container, caused by initiation of the explosive or propellant material and to be referred to as energetics herein. Without relief, this rapid pressure buildup often results in a sever deflagration reaction. Facilities and personnel are at a substantial risk. Pressure relief valves can not be used in containers for packaging ammunition since there must be sufficient area to vent the pressure buildup from ignited ammunition. No known relief valve exists having the required flow rate required to adequately vent the container.

It would be a great advance in the art if some device or method were to be devised that would package ammunition so that it could be transported and roughly handled under the requirements of military standards. Energetics will react if confined, so it would be of great advantage if a way could be devised to reduce the confinement provided by a sealed ammunition container to thereby reduce the seventy of the reaction.

Accordingly, it is an object of this invention to provide a metal container for ammunition that will be capable of reducing the damage to the surroundings in the event of a fire.

Another object of this invention is to provide such a container that substantially reduces fragments that are hazardous to personnel when the ammunition is contacted by fire.

Still another object of this invention is to reduce propagation to adjacent ammunition when ammunition stored in a metal container is exposed to fire.

A specific object is to provide a device for use with sealed ammunition containers that employ a vent area for pressure release of ignited energetics, to thereby reduce confinement to a level that is substantially less hazardous.

Other Objects will appear hereinafter.

SUMMARY OF THE INVENTION

It has now been discovered that the above and other objects of the present invention may be accomplished in the following manner. Specifically, the present invention is an improved sealed metal ammunition container for holding at least one round of ammunition.

The container body of conventional design is sized to hold the one or more rounds of ammunition as desired. The body has an opening at one end thereof. A metal bottom flange is fixedly attached to the container body at the one end and includes an opening therein sufficiently large to vent pressure from igniting ammunition contained therein. It is preferred that the bottom flange be fabricated from steel, and that it be welded to the body, although other metals may be suitable providing the container matierial is the same as the flange.

A metal top flange, again preferably steel, is provided for attachment to the bottom flange. The top flange also has a similar opening therein. A fuse formed from a material having a melting point below the ignition temperature of the ammunition is positioned between the top flange and the bottom flange to form a meltable closure at the open end of the body. A rubber flange gasket is positioned between the bottom flange and the fuse to form a hermetic seal when compressed upon closure thereof.

The preferred means for mounting the top flange and other components is by equally spaced screws. The screws are aligned with threaded holes in the bottom flange and securely mount the top flange, fuse, and flange gasket to the bottom flange to form a hermetic seal. An method of attaching the top to the bottom flange is to use self tapping screws.

The fuse is preferably formed from a synthetic material having a melting point between 190° F. and 270° F. Most preferred is an ionomer plastic material reinforced with glass fibers having a melting point of about 250° F. to about 270° F.

In operation, the ammunition is stored in a supply depot, ammunition warehouse or the like in the sealed ammunition container. In the event of a fire, the fuse material, having a melting point between 190° F. and 270° F., and preferably about 260° F., will melt. This melting of the plastic material takes place before the energetic reaches the temperature at which it ignites. The melted plastic falls away from the opening in the container body as it no longer is capable of being held by the flange assembly. As the ammunition is, in fact, exposed to the fire, the energetic is ignited, allowing the products of combustion to vent through the opening no longer covered by the melted fuse.

Prior to the fire, the ammunition is protected by a sealed, metal container having an intact durable bottom and capable of being cleaned in the event of nuclear, biological or chemical contamination. During the fire, the energetic combustion products are vented so that hazardous debris is greatly reduced, affording greater protection to personnel and the surroundings. Propagation to adjacent ammunition is also reduced.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 1:
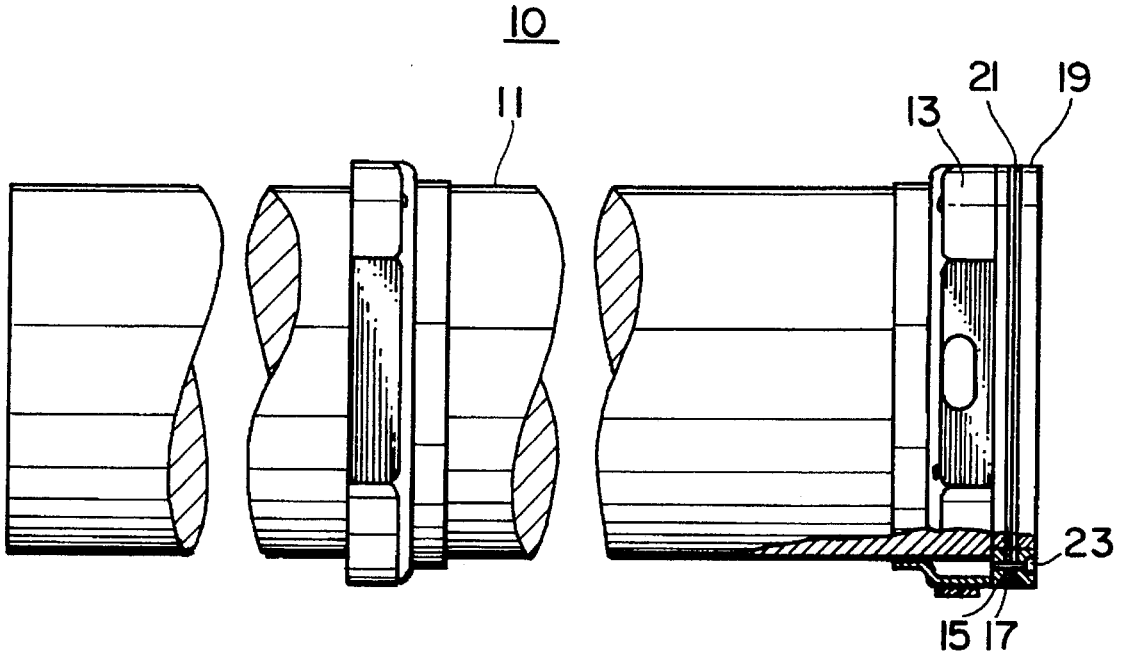
FIG. 1 is a schematic, side elevational view, partially shortened for convenience, showing the components of the preferred embodiment of the present invention in an exploded view.

As shown in the Figures, a sealed metal ammunition container, 10 generally, for holding at least one round of ammunition has a body 11 that terminates in a flange assembly 13. Body 11 is hollow, so that the ammunition may be placed therein as intended. Partially illustrated as FIG. 1 is a metal ammo container commonly identified by the container designation PA103E2, but any container designed to enclose or contain ammunition is suitable for use of the present invention. All that is needed is a sufficient cross section of the container which a flange assembly can be located that has an opening sufficient to vent the ignition products of the ammunition when ignited in accordance with this invention. The other end of body 11 is fitted with a cover, not shown and not part of the present invention, which seals the container and provides the normal access to the ammunition in the conventional manner.

Welded to the body 11 is a bottom flange 15. Flange 15 has an opening large enough so that when the assembly is contacted by fire, there is sufficient vent area to relieve the pressure from the ignited explosives. Flange 15 is welded or otherwise attached to ring 13. Preferred materials are, of course, metal, with a carbon steel cold-rolled strip or a carbon steel hot-rolled sheet and strip being preferred materials of construction. Common stock numbers ASTM-A-569 or ASTM-A-366 are two suitable metals for making the bottom flange 15.

The other side of the assembly of this invention is a top flange 19, which may be made from the same materials as bottom flange 15. Top flange 19 has the same external dimensions and thickness as bottom flange 15. The main difference between bottom flange 15 and top flange 19 is that top flange 19 has a plurality of holes, four in this case, for an attachment means while bottom flange 15 has four holes tapped therein for receiving and holding the attachment means. An alternate method of fastening the top flange to the bottom flange ls with self tapping screws which eliminate the need to tap the bottom flange.

Adjacent the bottom flange 15 is gasket flange 17, preferably made from rubber or another compressible material suitable for performing the function of a gasket. A preferred rubber material, again externally dimensioned the same as top and bottom flanges 19 and 15, creates the needed hermetic seal when torque sealing of the assembly is accomplished.

The final component of the assembly is a fuse 21, which comprises a sheet of meltable material having the outside dimensions of the three previously described components, 15, 17 and 19, but in this case with a solid center. The fuse 21 should be formed from a material having a melting point below the ignition temperature of the contained energetic. The fuse is positioned between bottom flange 15 and the combination of top flange 19 and gasket flange 17 to form a meltable closure at the open end of body 11. The fuse 21 may be made from any material that melts below the predetermined ignition temperature of the ammunition for the express purpose of melting to expose the open end to permit the fire to reach the ammunition through this opening and burn, so as to vent the ignition products through the opening.

A preferred material for fuse 21 is a synthetic material having a meltlng point below the ignition temperature of the energetic, in this case between 190° F. and 270° F. More preferred is an ionomer plastic material reinforced with glass fibers and which has a melting point of about 250° F. to about 270° F. One such ionomer plastic material is known as Formion FI388-3120, manufactured by A. Schulman Inc., of Akron, Ohio. The composite includes about 40% fiberglass, about 3.25% carbon black, and the balance is primarily the ionomer plastic. The material has the following properties: tensile strength at break of 5500 PSI; a melt index of 1.5 plus or minus 1.0 grams at 190° C.; flexural modulus of 400,000 PSI, a heat deflection temperature of 190° F., plus or minus 10° F. and a melting point of 260° F., plus or minus 10° F. It is preferred that fuse 21 be injection molded, most preferably from the middle of the part thather than from the ends.

Figure 2:
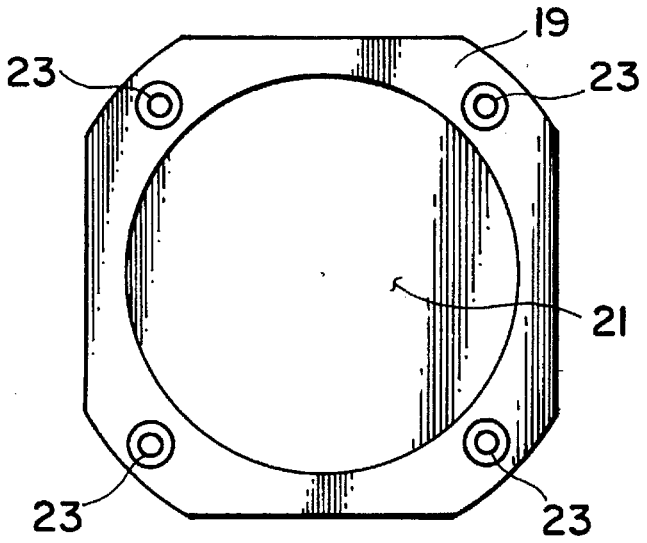
FIG. 2 is an end view of the device of FIG. 1.

As can be seen from FIGS. 1 and 2, the flange assembly generally is mounted to the body 11 by welding. Screws 23 pass through top flange 19, fuse 21, and gasket flange 17, which closes off the body 11. Flange 15 is, as noted above, welded to body 11 and screws 23 may be torqued to a desired tightness to insure that the seal at end 13 is at least as hermetic as that of the other, loading end of body 11.

In order to demonstrate the efficacy of the present invention, fire tests were conducted on the XM230 Unicharge round, which is a propelling charge for a 155 mm Howitzer. Two fire tests were conducted with such Unicharges packaged in unmodified metal ammunition containers, as a control, and two additional tests were performed using the device shown in FIGS. 1 and 2. The results of the tests demonstrated a significant reduction in hazardous debris. Specifically, the hazardous debris recorded after exploding the control, prior art containers were 347 and 514 feet respectively. Both tests using the container of the present invention resulted in hazardous debris thrown less than 50 feet, a substantial improvement. It was clear from the testing that the present invention is admirably suited to reduction of damage to surroundings, reduction of hazardous fragments to personnel, and reduced propagation to adjacent ammunition.

It is intended, of course, that a different design will be needed when a different metal ammunition container is employed. The description of the XM230 is for the purposes of example, not of limitation. The fuse may be made of a variety of materials and configurations, as long as the fusible material melts sufficiently for adequate venting of the metal ammunition container and all transportation/rough handling requirements are satisfied. Any or all of the components—top flange, bottom flange, gasket flange or fuse—may be made of different materials and configurations provided the hermetic seal of the container is not compromised.

While particular embodiments of the present invention have been illustrated and described herein, it is not intended that these illustrations and descriptions limit the invention. Changes and modifications may be made herein without departing from the scope and spirit of the following claims.

We claim:

1. A sealed metal ammunition container for holding at least one round of ammunition, comprising:

a metal ammunition container body sized to hold said aunmunition, said body having an opening at one end thereof;

a bottom flange fixedly attached to said container body at said one end, said bottom flange having an opening therein sufficiently large to vent pressure from igniting ammunition contained therein;

a top flange for attachment to said bottom flange, said top flange having an opening therein sufficiently large to vent pressure from igniting ammunition contained in said container;

a fuse formed from a material having a melting point below the ignition temperature of said ammunition, said fuse being positioned between said top flange and said bottom flange to form a meltable closure at said open end of said body, said fuse for limiting the conflagration caused by an ammunition fire;

a flange gasket positioned between said top flange and said fuse to form a hermetic seal when compressed upon closure thereof; and securing means for securing said top flange, fuse and gasket to said bottom flange to form said hermetic seal.

2. The container of claim 1, wherein said flange gasket is formed from rubber.

3. The container of claim 1, wherein said bottom and top flanges are formed from steel.

4. The container of claim 1, wherein said fuse is formed from a synthetic material having a melting point between 190° F. and 270° F.

5. The container of claim 4, wherein said synthetic material is an ionomer plastic material reinibrced with glass fibers and has a melting point of about 250° F. to about 270° F.

6. The container of claim 1, wherein said securing means comprises four equally spaced screws mounting said top flange, fuse, and flange gasket to said bottom flange.

7. A sealed metal ammunition container for holding at least one round of ammunition, comprising:

a metal ammunition container body sized to hold said ammunition, said body having an opening at one end thereof;

a metal bottom flange fixedly attached to said container body at said one end, said bottom flange having an opening therein sufficiently large to vent pressure from igniting ammunition contained therein;

a metal top flange for attachment to said bottom flange, said top flange having an opening therein sufficiently large to vent pressure from igniting ammunition contained in said container;

a fuse formed from a material having a melting point below the ignition temperature of said ammunition, said fuse being positioned between said top flange and said bottom flange to form a meltable closure at said open end of said body;

a rubber flange gasket positioned between said top flange and said fuse to form a hermetic seal when compressed upon closure thereof; and securing means for securing said top flange, fuse and gasket to said bottom flange to form said hermetic seal.

8. The container of claim 7, wherein said fuse is formed from a synthetic material having a melting point between 190° F. and 270° F.

9. The container of claim 7, wherein said fuse is an ionomer plastic material reinforced with glass fibers and has a melting point of about 250° F. to about 270° F.

* * * * *